US006056287A

United States Patent [19]

Hirth et al.

[11] Patent Number: 6,056,287

[45] Date of Patent: May 2, 2000

[54] DEVICE AND METHOD FOR DEPOSITING PRINTED SHEETS ON A STACK WITHOUT SMEARING

[75] Inventors: Roland Hirth, Roemerberg; Udo Lautenklos, Wald-Michelbach; Richard Burkhard Mack, Bruehl; Georg Roessler, Angelbachtal; Bernhard Wagensommer, Gaiberg, all of Germany

[73] Assignee: Heidelberger Druckmaschinen AG, Heidelberg, Germany

[21] Appl. No.: 08/863,361

[22] Filed: May 27, 1997

[30] Foreign Application Priority Data

May 24, 1996 [DE] Germany ..... 196 20 938

[51] Int. Cl.[7] ..... B65H 29/68

[52] U.S. Cl. ..... 271/204; 271/197; 271/183

[58] Field of Search ..... 271/182, 183, 271/197, 204

[56] References Cited

U.S. PATENT DOCUMENTS

| | | | |
|---|---|---|---|
| 5,265,863 | 11/1993 | Becker | 271/183 |
| 5,348,285 | 9/1994 | Huser | 271/197 X |
| 5,707,058 | 1/1998 | Hirth et al. | 281/183 X |

*Primary Examiner*—Christopher P. Ellis
*Assistant Examiner*—Patrick Mackey
*Attorney, Agent, or Firm*—Herbert L. Lerner; Laurence A. Greenberg; Werner H. Stemer

[57] ABSTRACT

A device for depositing paper sheets, in particular on a sheet pile or stack in a delivery of a printing machine, includes a revolving belt, a drive motor for driving the revolving belt separately from any other drive system, and at least one suction device having a discretely effective suction action, the suction device being disposed on the revolving belt, the revolving belt being constructed as a toothed belt for transmitting torque and synchronicity between the drive motor and the suction device; and a method of operating the depositing device.

2 Claims, 4 Drawing Sheets

20
22
23
21
n (U/h)
15000
1500
A
A'
B
C
D
90
180
270
360
φ (°)

LEGEND

POINT A≅ MACHINE ANGLE= GRIPPER OPENS

POINT B≅ MACHINE ANGLE

POINT C≅ MACHINE ANGLE

POINT D≅ MACHINE ANGLE

DEVICE AND METHOD FOR DEPOSITING PRINTED SHEETS ON A STACK WITHOUT SMEARING

BACKGROUND OF THE INVENTION

1. Field of the Invention

The invention relates to a device and a method for depositing printed sheets on a stack or pile whereby a printed sheet is decelerated or braked to a speed necessary for forming a precise stack or pile.

It has become known heretofore, for example from the published German Patent Document 44 35 988, to transport sheets out of a printing machine by revolving grippers held fast by a suction device at the trailing edge of the sheets, to decelerate and then release the sheets again for deposition on a stack or pile thereof. The suction device is located on a deceleration or braking belt guided over two deflection rollers and is accelerated and decelerated or braked in cycles according to a given speed profile in order, on the one hand, to hold the sheet by suction without relative speed with respect thereto and, on the other hand, to deposit the sheet on the stack at a reduced speed.

2. Summary of the Invention

It is accordingly an object of the invention to provide an improvement in the device and method of the general type described in the introduction hereto so that the synchronism of the sheet deposition relative to the machine angle is constantly maintained.

With the foregoing and other objects in view, there is provided, in accordance with one aspect of the invention, a device for depositing paper sheets, comprising a revolving belt, a drive motor for driving the revolving belt separately from any other drive system, and at least one suction device disposed on the revolving belt and having a discretely effective suction action, the revolving belt being constructed as a toothed belt for transmitting torque and synchronicity between the drive motor and the suction device.

In accordance with another feature of the invention, the depositing device includes a sheet pile in a delivery of a printing machine whereon the paper sheets are deposited.

In accordance with a further feature of the invention, the depositing device includes a coding provided on the revolving belt for detecting the position of the suction device.

In accordance with an added feature of the invention, the depositing device includes a driving gearwheel driven by the drive motor and operatively engaging with the toothed revolving belt, the toothed revolving belt having a number of teeth forming an integral ratio with the number of teeth of the driving gearwheel.

In accordance with another aspect of the invention, there is provided a method for depositing paper sheets on a sheet pile or stack in a delivery of a printing machine, which includes conveying the sheets by a revolving gripper system out of the printing machine and over the sheet pile, gripping a trailing edge of the sheets by a revolving suction device moving at a like relative speed therewith, releasing the sheets from the grippers and braking the sheets with the suction belt to an optimum deposition speed, maintaining corner points A, B, C, D of a speed profile of the revolving belt at a like machine angle irrespective of the speed of the printing machine, and synchronizing the revolving belt with the machine angle in accordance with the position of a rotor of a drive motor for driving the revolving belt.

In accordance with another mode, the method according to the invention includes synchronizing the revolving belt with a coding applied to the revolving belt.

A constituent part of the invention is the capability of determining, respectively, the position of the suction device and the instant of time at which the suction action occurs on the sheet. This is due to the fact that a revolving belt of the type described at the introduction hereto is constructed as a toothed belt which meshes directly or indirectly with a corresponding driving wheel. The drive motor provided for this purpose, which is connected to the driving wheel either directly or by a transmission, has a transmitter, by which the position of the rotor and of the driving wheel is known. The position of the suction device can be determined by the transmission ratio of the wheels and belts, respectively, which are involved in the drive, relative to the driving wheel.

A further feature of the invention calls for at least one interrogation device being provided for the position of the suction device. In the simplest case, the interrogation device may be constructed so that a signal is generated, respectively, at a specific setting of the suction device. If the number of teeth of the revolving belt is an integral multiple of the number of teeth of the driving gearwheel, the setting of the suction device can simply be deduced based upon the position of the motor. If the ratio can be represented by a rational number, control is implemented in a manner that a phase correction relative to the machine angle is always performed in the case of the smallest common multiple.

Direct recording of the position of the revolving belt is possible, for example, by an applied coding which is interrogated by a reflected light scanner. Precise angle control can be implemented with this arrangement. An advantageous further development of the invention calls for coupling the drive for the revolving belt with the gripper opening. The sheet, which is conveyed by chain-drawn gripper bars out of the printing machine over the delivery pile or stack, is released after a particular position by an opening of the grippers and is pressed onto the stack by blast air provided above the delivery. In order to prevent the sheet from slipping relative to the suction device after the sheet has been engaged by sucking, deceleration or braking of the suction device can take place only when the grippers have opened, i.e., when the sheet is being held only by the suction device. In order to achieve a constant braking travel or path of the sheet from machine speed to deposition speed, the opening of the grippers can be adapted in accordance with the machine speed.

The coupling with the opening of the grippers can be effected advantageously either by having the angle setting determined empirically or by providing a suitable sensor for determining the opening of the grippers and accordingly informing the control for the drive motor of the revolving belt. In the case of empirical determination, due regard is given to adjustment of the opening of the grippers by a gripper opening cam which is sufficiently known from the prior art and in which machine angle values for the opening of the grippers are stored in a memory, for example, in accordance with the setting of the gripper opening cam.

As a further advantage, a method according to the invention is provided, wherein there is no deceleration or braking of the suction device to remove a test sheet so that, with the stops pivoted away, the test sheet is conveyed so far over the delivery pile or stack as to ensure removal of the test sheet. As an alternative thereto, the suction action on the sheet can also be switched off, due to which the sheet can be removed without deceleration or braking, after the grippers have opened.

A release of the sheet at a defined position is assured by appropriate aeration, an application of excess pressure or the geometrical deformation of the suction device when it is guided around a deflection roller. Acceleration occurs only after release of the sheet. If the suction device is a revolving suction belt, provision is made, for example, to switch the suction action off for the interval of time of the different speeds between the suction belt and the sheets in order to prevent smearing. This means a clock cycle of the suction air, which may possibly be assisted by compressed air, synchronized with the sheets to be deposited. A targeted influencing of the instant of time at which contact of the sheet with the suction device occurs is thereby achieved.

The method according to the invention calls for decelerating or braking the sheet to a deposition speed which is always kept constant irrespective of the machine speed. However, an adaptation of the deposition speed to the different weight of the paper is provided. The corner points of the speed changes in the speed profile of the revolving belt remain:

A: Start of the deceleration operation

B: End of the deceleration operation

C: Start of acceleration

D: End of acceleration with the exception of the hereinafter described dependency relative to the gripper opening control, always irrespective of the machine speed at the same or like angle position. It thus follows that the function of deceleration or acceleration at a high machine speed is correspondingly steeper than at a low machine speed.

The stiffness of the sheet varies in accordance with the weight of the paper. In the case of thin paper, the sheet undergoes compression, as a result of which slight waviness occurs. It is therefore advantageous to make the opening of the grippers adjustable in accordance with the machine angle in order to be able to set the point or instant of time of opening, in the case of thin paper, as nearly as possible to the later position for depositing. This machine angle position corresponds to the start of the deceleration operation due to the coupling with the control of the drive motor for the revolving belt. By this manipulation on the part of the pressman, the start of the deceleration or braking operation A changes to A'. Points B, C and D maintain their position.

The device according to the invention calls for four different types of operation:

1. Uniform Deceleration Belt or Brake Band Operation:

In this regard, in first form or recto printing only, the deceleration or braking belt is always allowed to revolve at the deposition speed.

2. Non-uniform Deceleration Belt Operation:

In this regard, in recto and cover printing in the manner described at the introduction hereto, the deceleration or brake belt is alternately decelerated and again accelerated.

3. Non-uniform Brake Cam Operation:

Because, in recto-verso or first form and perfecter printing, both sides of the paper sheet are printed with ink which is still moist, it is necessary to grip the paper sheet at a nonprinted location, if possible. A brake cam which revolves with the suction belt is suited to this purpose.

4. Removal of Test Sheet:

In order to convey a test sheet beyond the position of depositing so as to be able to remove it, the deceleration of the deceleration or braking belt and cam, respectively, are stopped once or more times in accordance with the number of test sheets to be removed.

Other features which are considered as characteristic for the invention are set forth in the appended claims.

Although the invention is illustrated and described herein as embodied in a device for smear-free deposition of printed sheets on a stack or pile and a method of operating the device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1A:
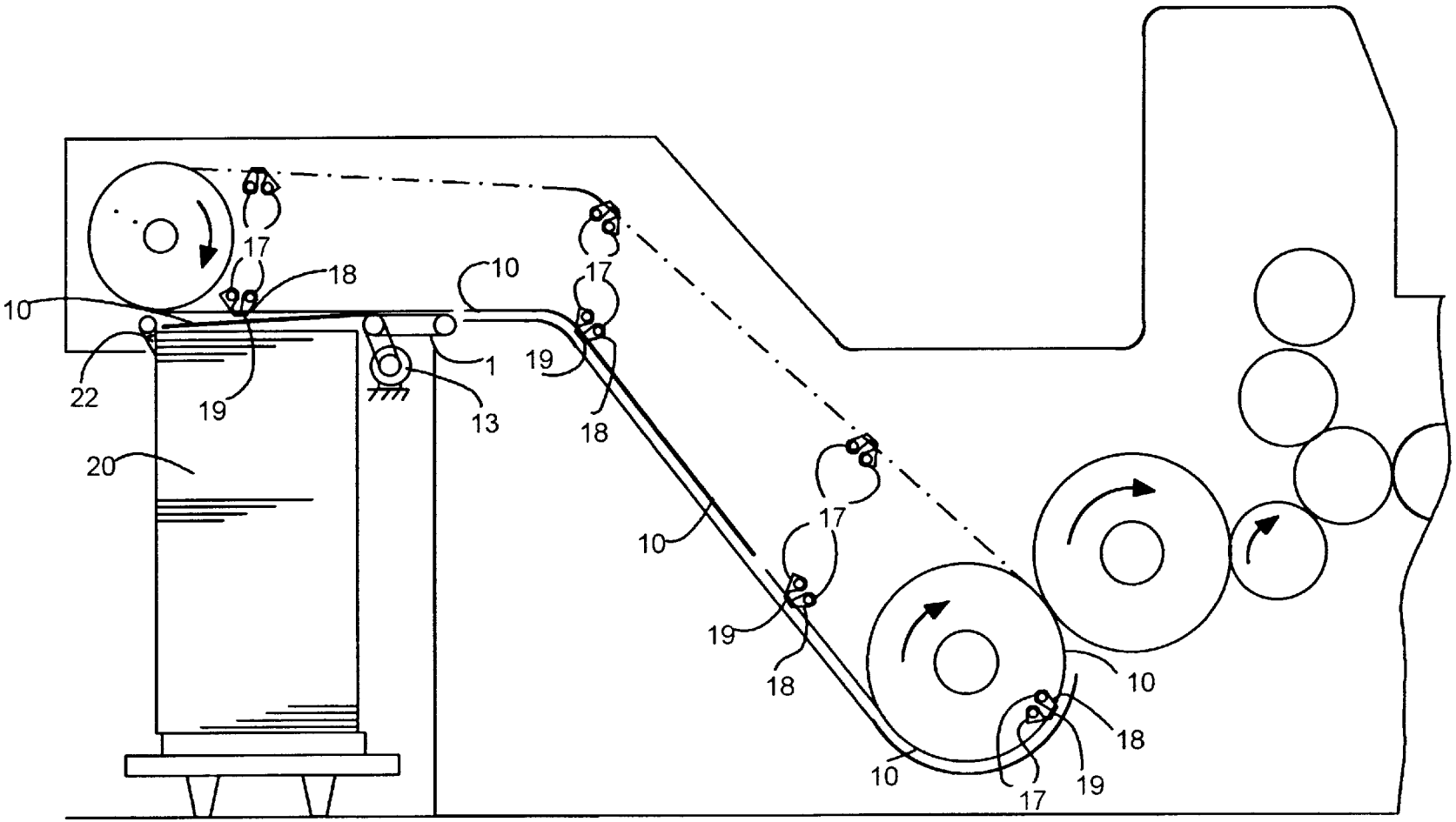
FIG. 1*a* is diagrammatic side elevational view of the device for decelerating or braking sheets showing further features.

Referring now to the drawings and, first, particularly to FIG. 1 thereof, there is shown therein a revolving belt 1 which has a toothed structure 2 on an inner side thereof and is guided around two deflection rollers 3 and 4. The revolving belt 1 is provided with a brake cam 5 at an outer contour thereof. A toothed belt 6 connects the deflection roller 3 to a drive wheel 7. The drive wheel 7, the two deflection rollers 3 and 4 and the toothed belt 6 have the same toothed structure 2 as that of the revolving belt 1. The drive wheel 7 is fastened onto a motor shaft 8 belonging to a drive motor 13. The brake cam 5 is guided between the deflection rollers 3 and 4 parallel to a suction box 9 having an opening formed in an upper side thereof, so that negative pressure prevailing therein acts upon the suction cam 5. The negative pressure at the suction cam 5 ensures that the trailing edge of a respective sheet 10 is brought into contact with the suction cam 5. The sheet 10 is conveyed by non-illustrated grippers out of a printing machine over a likewise non-illustrated delivery pile or stack. At the end of the suction box 9, as viewed in the direction of the arrow 11, the suction action on the sheet 10 is reduced to zero and the sheet 10 is released. In the case of very smooth paper, it is conceivable that the sheet 10 will continue to adhere to the suction cam despite the interruption in the suction action. For such a case, it is conceivable to consider that the suction box 9 is divided into a non-illustrated first section having negative pressure therein and a second section having excess pressure therein. In order to optimize the transfer of the negative pressure in the suction box 9 to the brake cam 5, provision is made for the toothed structure to be formed only at the outer edges of the revolving belt 1 and for a smooth structure to be formed in the region of the suction cam 5.

Figure 1B:
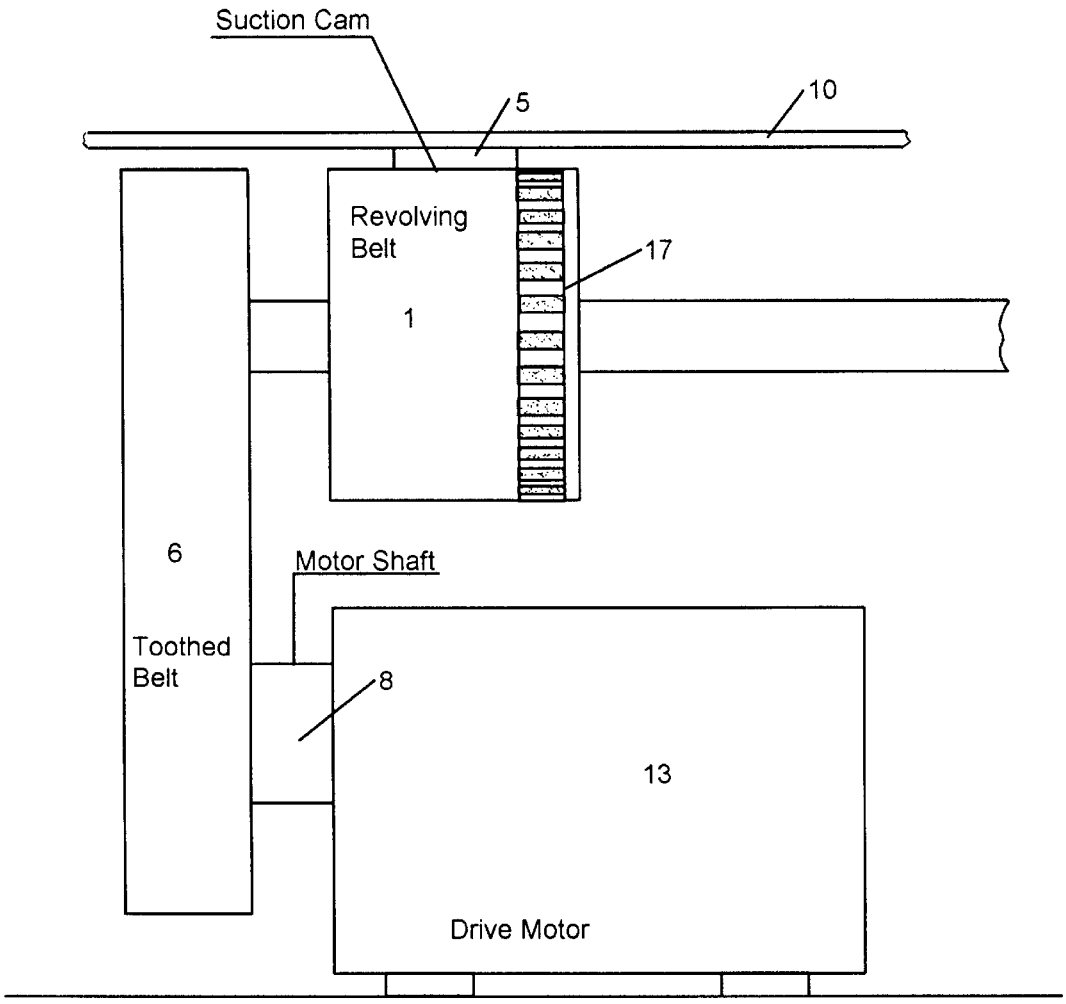
FIG. 1 is a diagrammatic side elevational view of a device for decelerating or braking sheets in accordance with the invention.

In order to be able to control the position of the suction cam 5 and the sheet 10, respectively, a coding 17 is applied to the revolving belt as shown in FIG. 1*b*. The coding 17 may, for example, be in the form of a reflecting or nonreflecting layer subdivided at regular spaced intervals. This coding 17 is interrogated by a reflected light scanner 12 and fed to a motor control 14. A so-called zero pulse is produced in the region of the suction cam 5, in order to determine the defined position of that pulse. Furthermore, information on the machine angle 15 is fed to the motor control 14 in order to establish the phase relationship between the suction cam 5 and the sheet 10. Gripper opening information 16 which is necessary for the braking function described hereinbefore is likewise fed to the motor control 14.

FIG. 1*a* shows revolving gripper systems 17 transporting sheets to a stack or pile 20. The gripper systems 17 each include a gripper support 18 and a gripper 19. A gripper system 17 grips the leading edge of the sheet 10 and releases the leading edge of the sheet 10 above the delivery pile or stack 20. At the time of release, the trailing edge of the sheet 10 is fixated by a revolving belt 1 which then further transports the sheet 10 against a stop 22 with a speed which is reduced as compared to the machine speed. The revolving belt 1 is driven by the motor 13 via a toothed belt 6.

Figure 2:
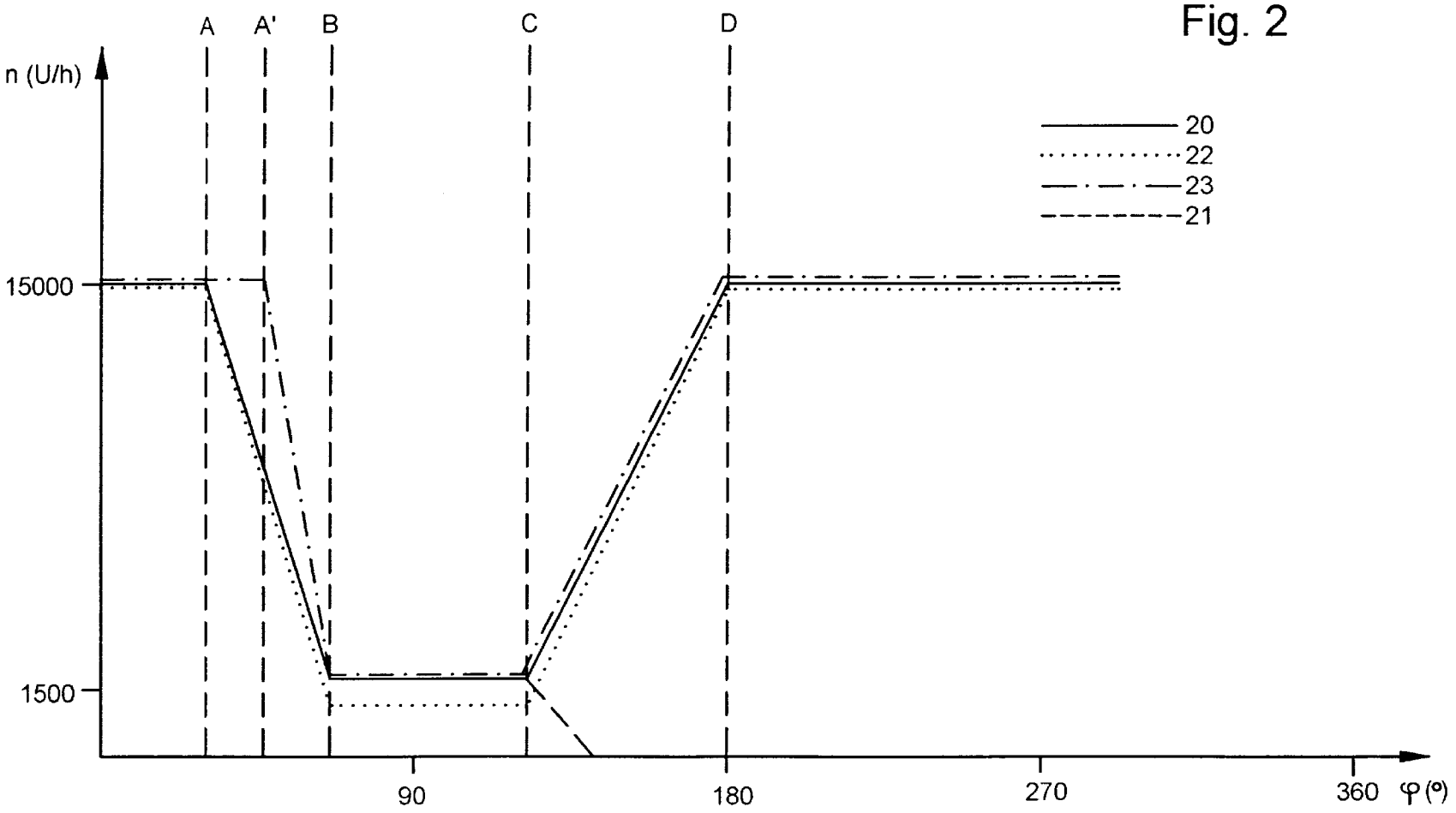
FIG. 2 is a plot diagram showing a speed profile of a revolving belt in accordance with or as a function of an angle setting of the printing machine.

FIG. 2 shows the speed profile of the revolving belt 1 in three different operating modes. An angle setting $\phi$ of the printing machine is plotted on the x-axis and the speed of the printing machine n in rph (revolutions per hour) is plotted on the y-axis. Up to point A, the revolving belt 1 and the sheet 10 move at the same speed. The application of suction to or the sucking up of the trailing edge of the sheet 10 by the suction cam 5 takes place in this section or period. Before or at point A, the opening of the grippers is completed and the motor control 14 is informed thereof by the gripper opening information 16. From point A to point B, the revolving belt 1 with the sheet 10 held by the suction cam 5 is decelerated or braked to deposition speed. From point B to point C, the revolving belt 1 maintains the deposition speed. After point C, the negative pressure of the suction box 9 which acts via the suction cam 5 upon the sheet 10 becomes inactive and the sheet 10 is released. The speed of the sheet 10 then varies approximately in accordance with the function represented by the line 21 until the sheet 10 reaches the rest position thereof on the delivery pile or stack. The revolving belt 1 follows the solid line 20 and is accelerated to machine speed again between the points C and D.

A second operating mode is represented by the dotted line 22, which likewise starts from a machine speed of 15,000 rph. For this printing material or stock, however, a slower deposition speed was selected, due to which a steeper deceleration and acceleration function results, because the corner points A, B, C and D remain unchanged.

A third operating mode represented by the phantom or dot-dash line 23 provides for the printing material or stock to require the grippers to be opened at a later point in time, and the deceleration or braking does not begin until the point A'. In this case, also, the function of the deceleration or braking is steeper because it ends at the point B. Otherwise, the function profile corresponds to that of the solid line 20.

Figure 3:
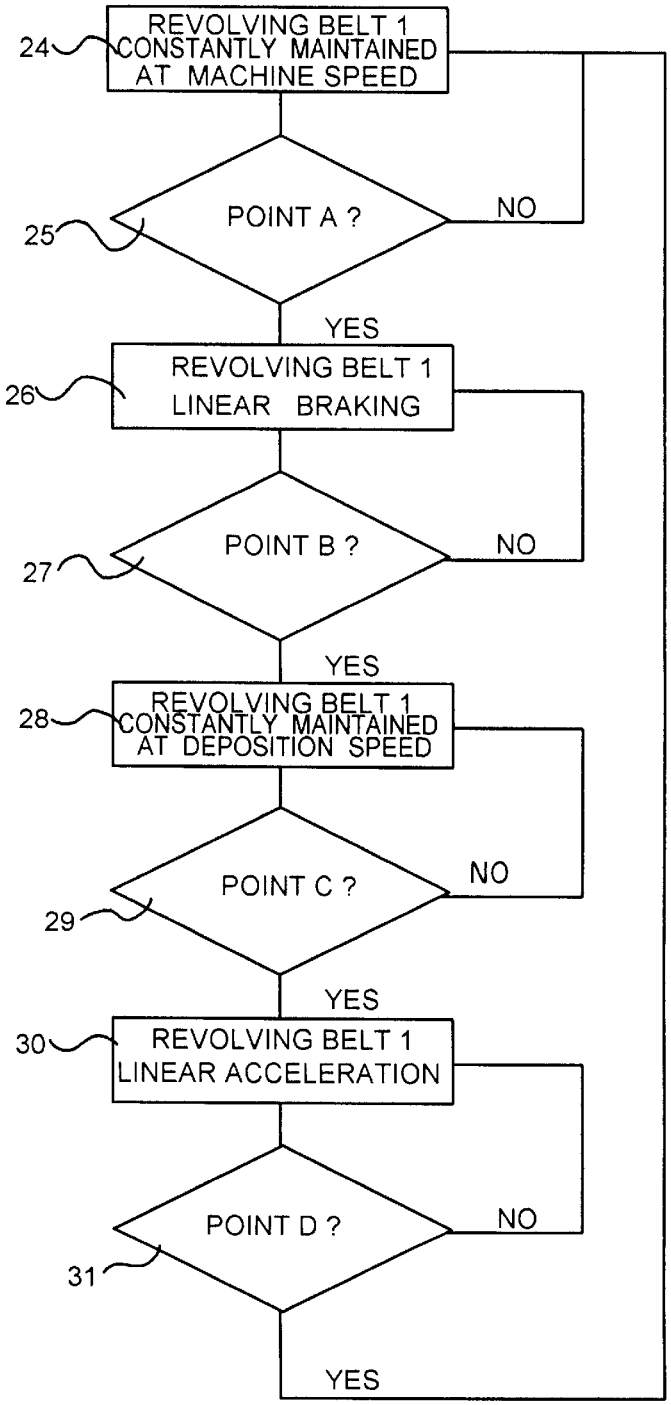
FIG. 3 is a flow chart depicting the operation of a motor control of FIG. 1 in accordance with the plot diagram of FIG. 2.

FIG. 3 is a flow chart in accordance with which the motor control 14, which is in the form of a computer, is programmable for performing the operation thereof as illustrated in the diagram of FIG. 2. Starting at 24, the revolving belt is constantly maintained at machine speed until the point A, at a machine angle of $\phi$ at which the grippers open, is reached at 25. At 26, the revolving belt 1 is braked or decelerated up to the point B at 27. The revolving belt 1 is constantly maintained at deposition speed at 28 until the point C is reached at 29. Then, the revolving belt 1 is linearly accelerated at 30 until the point D is reached at 31, and the process is then repeated.

We claim:

1. A method for depositing paper sheets on a sheet pile or stack in a delivery of a printing machine, which comprises:

conveying the sheets by a revolving gripper system out of the printing machine and towards the sheet pile or stack;

gripping only a trailing edge of the sheets by a suction device disposed on a revolving belt moving at the same relative speed therewith;

releasing the sheets from grippers of the gripper system and braking the sheets with the suction device to an optimum deposition speed;

after releasing the sheets from the grippers of the gripper system, transporting the sheets to a sheet pile with the suction device;

maintaining corner points A, B, C, D of a speed profile of the revolving belt at the same machine angle irrespective of the speed of the printing machine; and synchronizing the revolving belt with the machine angle.

2. The method according to claim 1, which includes synchronizing the revolving belt using a coding that has been applied to the revolving belt.

* * * * *